US010152942B2

(12) United States Patent
No et al.

(10) Patent No.: US 10,152,942 B2
(45) Date of Patent: Dec. 11, 2018

(54) DISPLAY APPARATUS AND METHOD OF OPERATING THE SAME

(71) Applicant: SAMSUNG DISPLAY CO., LTD., Yongin-si, Gyeonggi-Do (KR)

(72) Inventors: Sang Yong No, Seoul (KR); Kwihyun Kim, Yongin-si (KR); Youngsoo Sohn, Guri-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 7 days.

(21) Appl. No.: 15/394,994

(22) Filed: Dec. 30, 2016

(65) Prior Publication Data

US 2017/0193959 A1 Jul. 6, 2017

(30) Foreign Application Priority Data

Dec. 31, 2015 (KR) ..... 10-2015-0190836

(51) Int. Cl.
*G09G 3/36* (2006.01)
*G09G 3/3225* (2016.01)

(52) U.S. Cl.
CPC ..... *G09G 3/3696* (2013.01); *G09G 3/3677* (2013.01); *G09G 3/3688* (2013.01); *G09G 3/3225* (2013.01); *G09G 3/3614* (2013.01); *G09G 3/3648* (2013.01); *G09G 2310/0289* (2013.01); *G09G 2310/06* (2013.01); *G09G 2310/08* (2013.01); *G09G 2320/0204* (2013.01); *G09G 2320/0209* (2013.01); *G09G 2320/0219* (2013.01); *G09G 2320/0257* (2013.01)

(58) Field of Classification Search
CPC .. G09G 3/3225; G09G 3/3614; G09G 3/3648; G09G 3/3677; G09G 3/3688; G09G 3/3696; G09G 2310/06; G09G 2310/08; G09G 2320/0204; G09G 2320/0209; G09G 2320/0219; G09G 2320/0257
See application file for complete search history.

(56) References Cited

U.S. PATENT DOCUMENTS 6,331,846 B1 * 12/2001 Nakao ..... G09G 3/3614 330/252
2002/0145408 A1 * 10/2002 Morita ..... G09G 3/2011 323/280
2003/0020677 A1 * 1/2003 Nakano ..... G09G 3/3413 345/87

(Continued)

*Primary Examiner* — Michael J Eurice
(74) *Attorney, Agent, or Firm* — F. Chau & Associates, LLC

(57) ABSTRACT

A display apparatus includes a timing controller, a data driver and a display panel. The data driver generates a positive polarity data voltage and a negative polarity data voltage based on image data compensated by the timing controller. The display panel includes a first pixel driven based on the positive polarity voltage and a second pixel driven based on the negative polarity voltage. The display panel receives a storage voltage applied to the first pixel and the second pixel. The timing controller compensates the image data when a variation on a level of the storage voltage occurs. The compensation shifts a level of the first data voltage from a first normal level to a first compensation level in a direction, and shifts a level of the second data voltage from a second normal level to a second compensation level in the same direction.

24 Claims, 9 Drawing Sheets

(56) References Cited

U.S. PATENT DOCUMENTS

2003/0146923 A1* 8/2003 Nakahira ..... G09G 3/3696 345/690
2003/0169219 A1* 9/2003 LeChevalier ..... G09G 3/3216 345/84
2004/0183772 A1* 9/2004 Nakajima ..... G09G 3/2011 345/102
2006/0158412 A1* 7/2006 Morita ..... G09G 3/3655 345/94
2006/0214900 A1* 9/2006 Tsuchi ..... G09G 3/3688 345/98
2007/0063949 A1* 3/2007 Nomura ..... G09G 3/3688 345/89
2007/0085608 A1* 4/2007 Iriguchi ..... G09G 3/3688 330/260
2007/0126689 A1* 6/2007 Ishii ..... G09G 3/2011 345/100
2007/0139337 A1 6/2007 Yeh et al.
2007/0236289 A1* 10/2007 Iriguchi ..... H03F 3/45179 330/253
2008/0129904 A1* 6/2008 Kang ..... G09G 3/3648 349/37
2008/0143665 A1* 6/2008 Nishimura ..... G09G 3/3677 345/96
2008/0150866 A1* 6/2008 Maki ..... G09G 3/3688 345/89
2008/0174463 A1* 7/2008 Daito ..... G09G 3/3688 341/150
2008/0273002 A1* 11/2008 Kim ..... G02F 1/13452 345/98
2009/0021462 A1* 1/2009 Furihata ..... G09G 3/2011 345/89
2009/0079767 A1* 3/2009 Morita ..... G09G 3/3688 345/690
2009/0096816 A1* 4/2009 Kamijo ..... G09G 3/3688 345/690
2012/0069058 A1* 3/2012 Ichikura ..... G09G 3/3688 345/690
2012/0249607 A1* 10/2012 Ichikura ..... G09G 3/3688 345/690
2014/0176845 A1 6/2014 Uchida et al.
2015/0194086 A1* 7/2015 Kim ..... G09G 3/3688 345/214

* cited by examiner

DISPLAY APPARATUS AND METHOD OF OPERATING THE SAME

CROSS-REFERENCE TO RELATED APPLICATION

This application claims priority under 35 USC § 119 to Korean Patent Application No. 10-2015-0190836, filed on Dec. 31, 2015 in the Korean Intellectual Property Office (KIPO), the disclosure of which is incorporated by reference in its entirety herein.

BACKGROUND

1. Technical Field

Exemplary embodiments of the inventive concept relate generally to displaying images, and more particularly to display apparatuses and methods of operating the display apparatuses.

2. Discussion of Related Art

A liquid crystal display (LCD) apparatus includes a first substrate including a pixel electrode, a second substrate including a common electrode and a liquid crystal layer located between the first and second substrates. An electric field is generated by voltages applied to the pixel electrode and the common electrode. An intensity of the electric field may be adjusted to control transmittance of light passing through the liquid crystal layer, and thus, a desired image may be displayed.

When the electric field having a uniform direction is continuously applied to the liquid crystal layer, a characteristic of a liquid crystal may be degraded. The degradation of the characteristic of the liquid crystal may be reduced or prevented using an inversion driving scheme in which a polarity of a data voltage applied to the liquid crystal is reversed with respect to a common voltage during predetermined period. However, horizontal crosstalk may appear on a display panel operated used the inversion driving scheme.

SUMMARY

According to an exemplary embodiment of the inventive concept, a display apparatus includes a timing controller, a data driver and a display panel. The timing controller is for compensating input image data to generate output image data when a variation on a level of a storage voltage occurs. The data driver generates a first data voltage and a second data voltage based on the output image data. The first data voltage has a positive polarity with respect to a common voltage, and the second data voltage has a negative polarity with respect to the common voltage. The display panel includes a first pixel driven based on the first data voltage and a second pixel driven based on the second data voltage. The display panel receives a storage voltage applied to the first pixel and the second pixel. The compensating shifts a level of the first data voltage from a first normal level to a first compensation level in a direction, and shifts a level of the second data voltage from a second normal level to a second compensation level in the same direction.

In an exemplary embodiment, as a variation amount of the level of the storage voltage increases, both a shift amount of the level of the first data voltage and a shift amount of the level of the second data voltage increase.

In an exemplary embodiment, a frame image is displayed on the display panel based on the output image data. The frame image may be divided into a first region having a first grayscale and a second region having a second grayscale lower than the first grayscale. The first pixel and the second pixel may be located in the first region.

In an exemplary embodiment, as a size of the first region increases, a variation amount of the level of the storage voltage increases, and both a shift amount of the level of the first data voltage and a shift amount of the level of the second data voltage increase.

In an exemplary embodiment, as a difference between the first grayscale and the second grayscale increases, a variation amount of the level of the storage voltage increases, and both a shift amount of the level of the first data voltage and a shift amount of the level of the second data voltage increase.

In an exemplary embodiment, a shift amount of the level of the first data voltage is different from a shift amount of the level of the second data voltage.

In an exemplary embodiment, a difference between the first normal level and a level of the common voltage is greater than a difference between the first compensation level and the level of the common voltage. A difference between the second normal level and the level of the common voltage may be less than a difference between the second compensation level and the level of the common voltage.

In an exemplary embodiment, the timing controller decreases a first grayscale among a plurality of input grayscales included in the input image data and increases a second grayscale among the plurality of input grayscales. The first grayscale may correspond to the first pixel and the first data voltage having the positive polarity, and the second grayscale may correspond to the second pixel and the second data voltage having the negative polarity.

In an exemplary embodiment, the timing controller includes an image processor. The image processor may generate a plurality of output grayscales included in the output image data by compensating a plurality of input grayscales included in the input image data.

In an exemplary embodiment, the image processor includes a first circuit, a second circuit, a third circuit, a fourth circuit and a fifth circuit. The first circuit may convert the plurality of input grayscales into a plurality of input voltages based on a lookup table. The second circuit may generate a first average voltage of first input voltages among the plurality of input voltages and a second average voltage of second input voltages among the plurality of input voltages. The first input voltages may correspond to a first horizontal line of the display panel, and the second input voltages may correspond to a second horizontal line of the display panel adjacent to the first horizontal line. The third circuit may generate a second estimation value for a voltage variation associated with the second horizontal line based on the first average voltage, the second average voltage and a first estimation value for a voltage variation associated with the first horizontal line. The fourth circuit may compensate the second input voltages based on the second estimation value. The fifth circuit may convert the compensated second input voltages into some grayscales among the plurality of output grayscales based on the lookup table.

In an exemplary embodiment, the third circuit may further generate a fourth estimation value for the voltage variation associated with the second horizontal line based on the second average voltage and a third estimation value for the voltage variation associated with the first horizontal line. The fourth circuit may additionally compensate the second input voltages based on the fourth estimation value.

In an exemplary embodiment, the first pixel includes a first pixel electrode, a first storage capacitor and a first switching element. The first switching element is connected between the first pixel electrode and a first data line to which the first data voltage is applied, and includes a control electrode connected to a first gate line. The first storage capacitor is located between the first pixel electrode and a storage electrode to which the storage voltage is applied.

In an exemplary embodiment, the first pixel includes first and second sub-pixels. The first sub-pixel includes a first pixel electrode, a first switching element, a second switching element and a first storage capacitor. The first switching element is connected between the first pixel electrode and a first data line to which the first data voltage is applied, and includes a control electrode connected to a first gate line. The second switching element is connected between the first pixel electrode and the storage voltage, and includes a control electrode connected to the first gate line. The second sub-pixel includes a second pixel electrode and third switching element. The third switching element is connected between the second pixel electrode and the first data line, and includes a control electrode connected to the first gate line.

According to an exemplary embodiment of the inventive concept, a method of operating a display apparatus includes: compensating input image data to generate output image data when a variation on a level of a storage voltage occurs; generating a first data voltage and a second data voltage are generated based on the output image data, the first data voltage having a positive polarity with respect to a common voltage, and the second data voltage having a negative polarity with respect to the common voltage; providing the storage voltage to a display panel included in the display apparatus; and driving a first pixel and a second pixel included in the display panel based on the first data voltage and the second data voltage, respectively. The compensating shifts a level of the first data voltage from a first normal level to a first compensation level in a direction, and shifts a level of the second data voltage from a second normal level to a second compensation level in the same direction.

In an exemplary embodiment, as a variation amount of the level of the storage voltage increases, both a shift amount of the level of the first data voltage and a shift amount of the level of the second data voltage increase.

In an exemplary embodiment, a frame image is displayed on the display panel based on the output image data. The first frame image is divided into a first region having a first grayscale and a second region having a second grayscale lower than the first grayscale. The first pixel and the second pixel may be located in the first region.

In an exemplary embodiment, as a size of the first region increases or as a difference between the first grayscale and the second grayscale increases, a variation amount of the level of the storage voltage increases, and both a shift amount of the level of the first data voltage and a shift amount of the level of the second data voltage increase.

In an exemplary embodiment, a difference between the first normal level and a level of the common voltage is greater than a difference between the first compensation level and the level of the common voltage. A difference between the second normal level and the level of the common voltage may be less than a difference between the second compensation level and the level of the common voltage.

In an exemplary embodiment, the compensating includes: converting a plurality of input grayscales included in the input image data into a plurality of input voltages based on a lookup table; generating a first average voltage of first input voltages among the plurality of input voltages and a second average voltage of second input voltages among the plurality of input voltages, the first input voltages corresponding to a first horizontal line of the display panel, and the second input voltages corresponding to a second horizontal line of the display panel adjacent to the first horizontal line; generating a second estimation value for a voltage variation associated with the second horizontal line based on the first average voltage, the second average voltage and a first estimation value for a voltage variation associated with the first horizontal line; compensating the second input voltages based on the second estimation value; and converting the compensated second input voltages into some grayscales among a plurality of output grayscales included in the output image data based on the lookup table.

In an exemplary embodiment, the compensating includes: generating a fourth estimation value for the voltage variation associated with the second horizontal line may be generated based on the second average voltage and a third estimation value for the voltage variation associated with the first horizontal line; and compensating the second input voltages based on the fourth estimation value.

According to an exemplary embodiment of the inventive concept, a display apparatus includes a timing controller, a data driver and a display panel. The timing controller is for compensating input image data to generate output image data when a frame image in the input image data includes first region having a low grayscale adjacent a second region having a high grayscale. The data driver is configured to generate a positive polarity data voltage and a negative polarity data voltage based on the output image data. The display panel includes a first pixel driven based on the first data voltage and a second pixel driven based on the second data voltage, and the display panel is configured to receive a storage voltage applied to the first pixel and the second pixel. The compensating shifts a level of the first data voltage from a first normal level to a first compensation level in a direction, and shifts a level of the second data voltage from a second normal level to a second compensation level in the same direction.

In an embodiment, the first region is a rectangular box and the second region surrounds the first region.

In an embodiment, the compensating occurs during a period the frame image is applied where the storage voltage varies.

In a display apparatus according to at least one embodiment of the inventive concept, first and second pixels may be driven based on the first and second data voltages having different polarities, respectively. When the variation on the level of the storage voltage applied to the first and second pixels occurs, image data and/or a gamma reference voltage may be compensated such that the first and second data voltages are shifted in the same direction. Accordingly, a display defect such as a horizontal crosstalk on the display panel may be prevented, and the display apparatus may have relatively improved display quality.

BRIEF DESCRIPTION OF THE DRAWINGS

Exemplary embodiments of the inventive concept will be more clearly understood from the following detailed description taken in conjunction with the accompanying drawings.

DETAILED DESCRIPTION OF THE EMBODIMENTS

Figure 1:
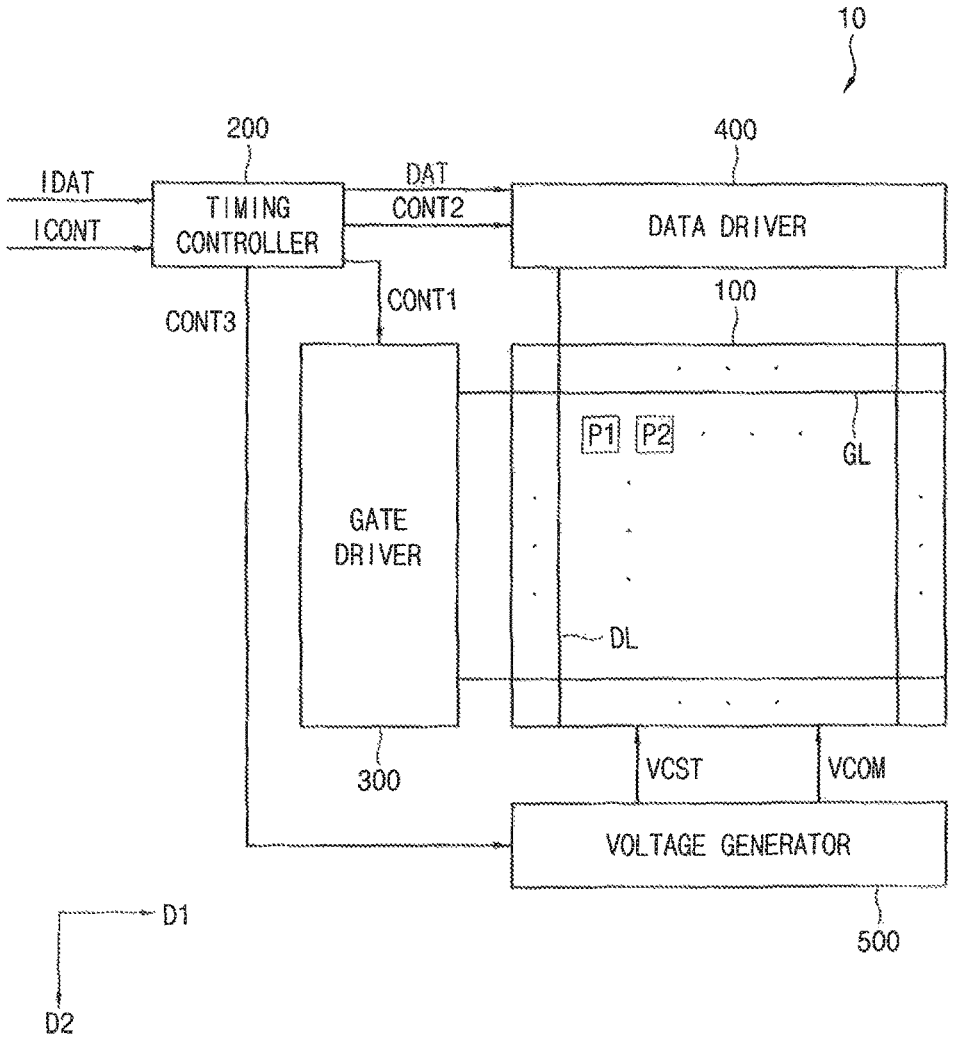
FIG. 1 is a block diagram illustrating a display apparatus according to an exemplary embodiment of the inventive concept.

The inventive concept will be described more fully with reference to the accompanying drawings, in which exemplary embodiments thereof are shown. This inventive concept may, however, be embodied in many different forms and should not be construed as limited to the embodiments set forth herein. Like reference numerals refer to like elements throughout this application. As used herein, the singular forms, "a," "an" and "the" are intended to include the plural forms as well, unless the context clearly indicates otherwise.

FIG. 1 is a block diagram illustrating a display apparatus according to an exemplary embodiment of the inventive concept.

Referring to FIG. 1, a display apparatus 10 includes a display panel 100, a timing controller 200, a gate driver 300, a data driver 400 and a voltage generator 500.

The display panel 100 operates (e.g., displays an image) based on output image data DAT. The display panel 100 is connected to a plurality of gate lines GL and a plurality of data lines DL. The gate lines GL may extend in a first direction D1, and the data lines DL may extend in a second direction D2 crossing (e.g., substantially perpendicular to) the first direction D1. The display panel 100 may include a plurality of pixels that are arranged in a matrix form. For example, the plurality of pixels may include a first pixel P1 and a second pixel P2. Each pixel (e.g., the first pixel P1) may be electrically connected to a respective one of the gate lines GL and a respective one of the data lines DL.

The timing controller 200 controls an operation of the display panel 100, and controls operations of the gate driver 300, the data driver 400 and the voltage generator 500. The timing controller 200 receives input image data IDAT and an input control signal ICONT from an external device (e.g., a host or a graphic processor). The input image data IDAT may include a plurality of input grayscales for the plurality of pixels. The input control signal ICONT may include a master clock signal, a data enable signal, a vertical synchronization signal, a horizontal synchronization signal, etc.

The timing controller 200 generates the output image data DAT based on the input image data IDAT. The output image data DAT may include a plurality of output grayscales for the plurality of pixels. The timing controller 200 generates a first control signal CONT1 based on the input control signal ICONT. The first control signal CONT1 may be provided to the gate driver 300, and a driving timing of the gate driver 300 may be controlled based on the first control signal CONT1. For example, the first control signal CONT1 may include a vertical start signal, a gate clock signal, etc. The timing controller 200 generates a second control signal CONT2 based on the input control signal ICONT. The second control signal CONT2 may be provided to the data driver 400, and a driving timing of the data driver 400 may be controlled based on the second control signal CONT2. For example, the second control signal CONT2 may include a horizontal start signal, a polarity control signal, a data load signal, etc. The timing controller 200 generates a third control signal CONT3 based on the input control signal ICONT. The third control signal CONT3 may be provided to the voltage generator 500, and the voltage generator 500 may be controlled based on the third control signal CONT3.

The gate driver 300 generates a plurality of gate signals for driving the gate lines GL based on the first control signal CONT1. The gate driver 300 may sequentially provide the gate signals to the gate lines GL.

The data driver 400 generates a plurality of data voltages (e.g., analog voltages) for driving the data lines DL based on the output image data DAT (e.g., digital data) and the second control signal CONT2. The data driver 400 may sequentially provide the data voltages to the data lines DL.

The voltage generator 500 generates a storage voltage VCST and a common voltage VCOM based on the third control signal CONT3. The voltage generator 500 may provide the storage voltage VCST and the common voltage VCOM to the display panel 100 through or via at least one storage line and at least one common line, respectively.

In some exemplary embodiments, the gate driver 300, the data driver 400 and/or the voltage generator 500 may be disposed, e.g., directly mounted, on the display panel 100, or may be connected to the display panel 100 in a tape carrier package (TCP) type. Alternatively, the gate driver 300, the data driver 400 and/or the voltage generator 500 may be integrated on the display panel 100.

The display apparatus 10 according to an exemplary embodiment of the inventive concept operates based on an inversion driving scheme in which a polarity of a data voltage applied to each pixel is reversed with respect to the common voltage VCOM at every predetermined period (e.g., at a single frame period). A characteristic of liquid crystals in the display panel 100 might not be degraded and might be preserved due to the inversion driving scheme. For example, the display panel 100 may have a polarity pattern of a dot or diagonal inversion where a single pixel is surrounded on its top, bottom, left and right by pixels having a polarity opposite to that of the single pixel, or a polarity pattern of a line inversion (e.g., a column inversion or a row inversion) where pixels in a single column or row have the same polarity as each other.

Hereinafter, an operation of the display apparatus 10 according to exemplary embodiments will be described in detail based on two pixels (e.g., the first and second pixels P1 and P2) in the display panel 100 that are driven based on data voltages having different polarities.

Figure 2:
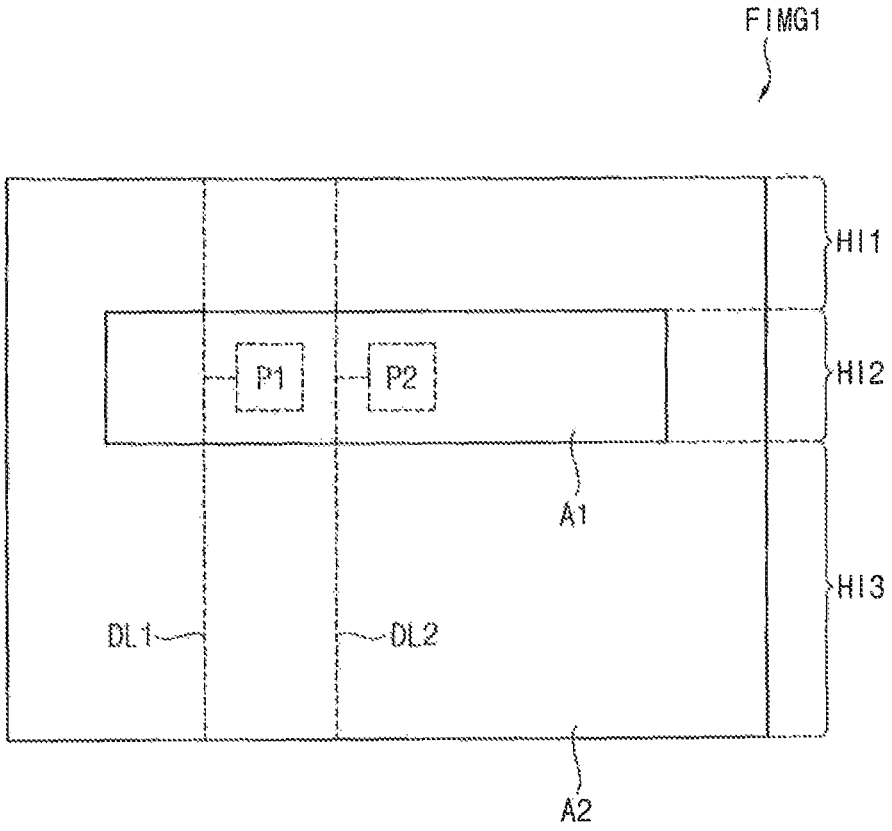
FIGS. 2, 3 and 4 are diagrams for describing an operation of the display apparatus according to an exemplary embodiment of the inventive concept.
Figure 3:
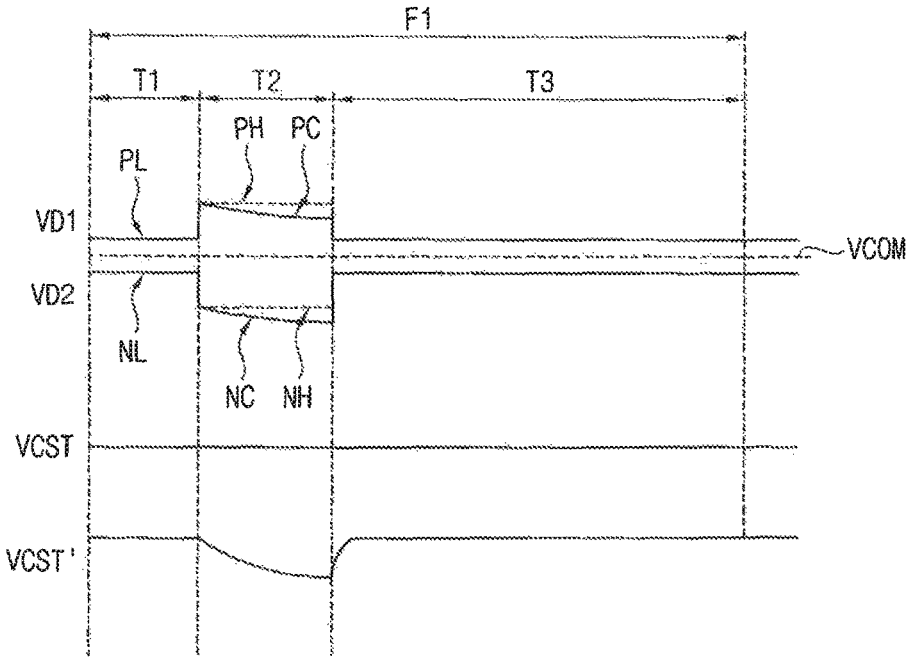
Figure 4:
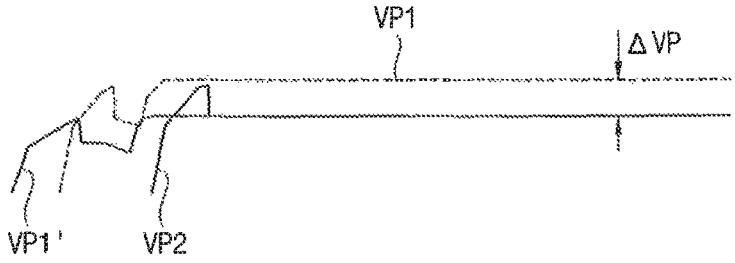

FIGS. 2, 3 and 4 are diagrams for describing an operation of the display apparatus according to an exemplary embodiment of the inventive concept.

FIG. 2 illustrates an example of a frame image that is displayed on the display panel 100 in FIG. 1. FIG. 3 illustrates waveforms of data voltages and a storage voltage that are applied to the display panel 100 in FIG. 1. FIG. 4 illustrates waveforms of voltages at pixels (e.g., at pixel electrodes) that are included in the display panel 100 in FIG. 1.

Referring to FIGS. 1 and 2, the display panel 100 displays a first frame image FIMG1 based on the output image data DAT. The first frame image FIMG1 includes first horizontal line images HI1, second horizontal line images HI2 and third horizontal line images HI3. For example, the first frame image FIMG1 may be an image for testing the display panel 100 (e.g., a test image).

A single frame image may represent an image that is displayed on the display panel 100 during one frame period. A single horizontal line image may represent an image that is displayed on a portion of the display panel 100 during one horizontal period and is maintained during one frame period including the one horizontal period. For example, the display panel 100 may include a plurality of horizontal lines, each of which corresponds to a single pixel row. Each horizontal line in the display panel 100 may display a respective one horizontal line image, and the display panel 100 may display one frame image (e.g., FIMG1) based on a plurality of horizontal line images (e.g., HI1, HI2 and HI3) displayed on the plurality of horizontal lines. For example, a single horizontal line may correspond to a single gate line or pixels connected to a single gate line.

In addition, the display panel 100 may include a plurality of vertical lines, each of which corresponds to a single pixel column. For example, a single vertical line may correspond to a single data line or pixels connected to a single data line.

The first frame image FIMG1 is divided into a first region A1 having a first grayscale and a second region A2 having a second grayscale. In an embodiment, the second grayscale is lower than the first grayscale. For example, the first grayscale may correspond to a relatively high grayscale (e.g., white or light grey), and the second grayscale may correspond to a relatively low grayscale (e.g., black or dark grey). In an embodiment, the high grayscale is full intensity (e.g., 255/255, 511/511, etc) and the low grayscale is zero intensity (e.g., 0/255, 0/511, etc.). In an embodiment, the high grayscale is several times (e.g., 10 to 20 times) the low grayscale. The first region A1 is surrounded by the second region A2. In an embodiment, the first region A1 has a rectangular shape, and thus the first region A1 may be referred to as a box region. In an embodiment, the first and third horizontal line images HI1 and HI3 only display the second grayscale, and the second horizontal line images HI2 display both the first grayscale and the second grayscale.

The first pixel P1 and the second pixel P2 are located in the first region A1. In other words, each of the first pixel P1 and the second pixel P2 display the first grayscale. The first pixel P1 is electrically connected to a first data line DL1, and the second pixel P2 is electrically connected to a second data line DL2.

According to exemplary embodiments, the first pixel P1 and the second pixel P2 may be disposed in the same horizontal line or different horizontal lines. Similarly, the first pixel P1 and the second pixel P2 may be disposed in the same vertical line or different vertical lines.

In FIG. 3, VD1 represents a data voltage that is applied to the first data line DL1 for displaying the first frame image FIMG1, and VD2 represents a data voltage that is applied to the second data line DL2 for displaying the first frame image FIMG1. Each of VCST and VCST' represent a storage voltage. In an embodiment, the storage voltage VST' is applied to a storage capacitor of the first pixel P1 and a storage capacitor of the second pixel P2. In an embodiment, each pixel includes a thin film transistor TFT where a source terminal of the TFT is connected to a data line, a gate terminal of the TFT is connected to a gate line, and a liquid crystal capacitor and storage capacitor are connected to a drain terminal of the TFT. F1 represents a first frame period for displaying the first frame image FIMG1. T1 represents first horizontal periods for displaying the first horizontal line images HI1, T2 represents second horizontal periods for displaying the second horizontal line images HI2, and T3 represents third horizontal periods for displaying the third horizontal line images HI3.

Referring to FIGS. 1, 2 and 3, the timing controller 200 generates the output image data DAT by compensating the input image data IDAT. For example, the timing controller 200 may generate the plurality of output grayscales included in the output image data DAT by compensating the plurality of input grayscales included in the input image data IDAT. An operation for compensating the input image data IDAT and the input grayscales will be described in detail.

In the display apparatus 10 according to an exemplary embodiment of the inventive concept, the first pixel P1 and the second pixel P2 are operated/driven based on data voltages having different polarities.

For example, the data driver 400 generates a first data voltage VD1 and a second data voltage VD2 based on the output image data DAT. The first data voltage VD1 has a positive polarity with respect to the common voltage VCOM, and the second data voltage VD2 has a negative polarity with respect to the common voltage VCOM. In other words, a level of the first data voltage VD1 is higher than a level of the common voltage VCOM, and a level of the second data voltage VD2 is lower than the level of the common voltage VCOM. The first data voltage VD1 may be referred to as a positive polarity data voltage, and the second data voltage VD2 may be referred to as a negative polarity data voltage. The first pixel P1 displays a desired grayscale based on a level difference between the first data voltage VD1 and the common voltage VCOM. For example, a grayscale displayed on the first pixel P1 may increase if the level difference between the first data voltage VD1 and the common voltage VCOM increases. Similarly, the second pixel P2 displays a desired grayscale based on a level difference between the second data voltage VD2 and the common voltage VCOM.

The display panel 100 displays the first frame image FIMG1 based on the plurality of data voltages including the first data voltage VD1 and the second data voltage VD2. For example, the first data voltage VD1 may have a positive polarity low level PL for displaying the second grayscale (e.g., a relatively low grayscale) during the first and third horizontal periods T1 and T3, and may have a level PC for displaying the first grayscale (e.g., a relatively high grayscale) during the second horizontal periods T2. In an embodiment, the level PC is higher than the positive polarity low level PL. Similarly, the second data voltage VD2 may have a negative polarity low level NL for displaying the second grayscale during the first and third horizontal periods T1 and T3, and may have a level NC for displaying the first grayscale during the second horizontal periods T2. In an embodiment, the level NC is lower than the negative polarity low level NL.

The display panel 100 receives the storage voltage VCST from the voltage generator 500, and then the first pixel P1 and the second pixel P2 receive the storage voltage VCST'. In an embodiment, the storage voltage VCST output from the voltage generator 500 has a fixed level during a whole operation period. A level of the storage voltage VCST' applied to each pixel in the display panel 100 may vary depending on a grayscale displayed by each pixel and/or a location of each pixel in the display panel 100. For example, the level of the storage voltage VCST' may be changed, varied or fluctuated due to a ripple and/or an IR drop on a storage line through which the storage voltage VCST is provided. For example, the level of the storage voltage VCST' applied to the pixels P1 and P2 may be reduced by such ripple and/or IR drop (e.g., caused by the box region A1) during the second horizontal periods T2.

In the display apparatus 10 according to an exemplary embodiment, the timing controller 200 performs a grayscale compensation for mitigating deterioration of a display quality due to such variation on the level of the storage voltage VCST', and then the data voltages (e.g., VD1 and VD2) applied to the pixels (e.g., P1 and P2) are compensated (e.g., levels of the data voltage may be shifted) based on the grayscale compensation.

For example, as illustrated in FIG. 3, when the level of the storage voltage VCST' applied to the pixels P1 and P2 varies, e.g., during the second horizontal periods T2, the level of the first data voltage VD1 is shifted from a positive polarity high level PH to the level PC in a first direction, and the level of the second data voltage VD2 is shifted from a negative polarity high level NH to the level NC in the first direction. In an embodiment, the first data voltage VD1 is increased from the positive polarity low level PL to the positive polarity high level PH at the beginning of period T2, and then the first data voltage VD1 is gradually reduced thereafter during period T2 to the level PC, and then the first data voltage VD1 is set to the positive polarity low level PL during period T3. In an embodiment, the second data voltage VD2 is decreased from the negative polarity low level NL to the negative polarity high level NH at the beginning of period T2, and then the second data voltage VD2 is gradually reduced thereafter during period T2 to the level NC, and then the second data voltage VD2 is set to the negative polarity high level NL during period T3. The positive polarity high level PH and the negative polarity high level NH may be referred to as a first normal level and a second normal level, respectively. The level PC and the level NC for displaying the first grayscale may be referred to as a first compensation level and a second compensation level, respectively.

In the embodiment of FIG. 3, the first direction indicates a direction in which a voltage level is reduced, and then the level of the first data voltage VD1 and the level of the second data voltage VD2 are shifted in the same direction toward a level of a ground voltage (e.g., about 0V). Thus, a voltage difference between the first data voltage VD1 and the common voltage VCOM decrease, and a voltage difference between the second data voltage VD2 and the common voltage VCOM increase. In other words, a difference between the first normal level PH and the level of the common voltage VCOM is greater than a difference between the first compensation level PC and the level of the common voltage VCOM. A difference between the second normal level NH and the level of the common voltage VCOM is less than a difference between the second compensation level NC and the level of the common voltage VCOM. To compensate the data voltages VD1 and VD2 as illustrated in FIG. 3, the timing controller 200 decreases a positive polarity grayscale corresponding to the first pixel P1 and increases a negative polarity grayscale corresponding to the second pixel P2.

In an exemplary embodiment, as a variation amount of the level of the storage voltage VCST' increases, both a shift amount of the level of the first data voltage VD1 and a shift amount of the level of the second data voltage VD2 increases. In an exemplary embodiment, as a size of the first region A1 increases, the variation amount of the level of the storage voltage VCST' increases, and thus both the shift amount of the level of the first data voltage VD1 and the shift amount of the level of the second data voltage VD2 increases. For another example, as a difference between the first grayscale and the second grayscale increases (e.g., as a grayscale difference between the first region A1 and the second region A2 increases), the variation amount of the level of the storage voltage VCST' increases, and thus both the shift amount of the level of the first data voltage VD1 and the shift amount of the level of the second data voltage VD2 increases. In an exemplary embodiment, as a distance between the first region A1 and the data driver 400 increases (e.g., as the first region A1 becomes farther away from the data driver 400), the variation amount of the level of the storage voltage VCST' increases, and thus both the shift amount of the level of the first data voltage VD1 and the shift amount of the level of the second data voltage VD2 increases. In an embodiment, the variation amount is the difference between the storage voltage VCST' at its highest point at the beginning of T2 and its lowest point at the end of T2.

In an exemplary embodiment, the shift amount of the level of the first data voltage VD1 is substantially the same as or exactly the same as the shift amount of the level of the second data voltage VD2. In an exemplary embodiment, the shift amount of the level of the first data voltage VD1 is different from the shift amount of the level of the second data voltage VD2.

In an exemplary embodiment, changes in the first compensation level PC and the second compensation level NC over time during the second horizontal periods T2 in FIG. 3 are similar to a portion of a graph of an exponential function of "exp(−t)".

Referring to FIGS. 2, 3 and 4, if the data voltages VD1 and VD2 are not compensated while the variation on the level of the storage voltage VCST' occurs, a saturation or stabilization level of a voltage VP1 at a pixel (e.g., P1) included in the first region A1 may be different from a saturation or stabilization level of a voltage VP2 at a pixel included in the second region A2 by ΔVP. A display defect such as a horizontal crosstalk may appear on the display panel 100 due to such difference ΔVP.

If the data voltages VD1 and VD2 are compensated according to exemplary embodiments while the variation on the level of the storage voltage VCST' occurs, a saturation or stabilization level of a voltage VP1' at the pixel (e.g., P1) included in first region A1 may be substantially the same as the saturation or stabilization level of the voltage VP2 at the pixel included in second region A2. Accordingly, a display defect such as a horizontal crosstalk on the display panel 100 may be prevented.

Figure 5:
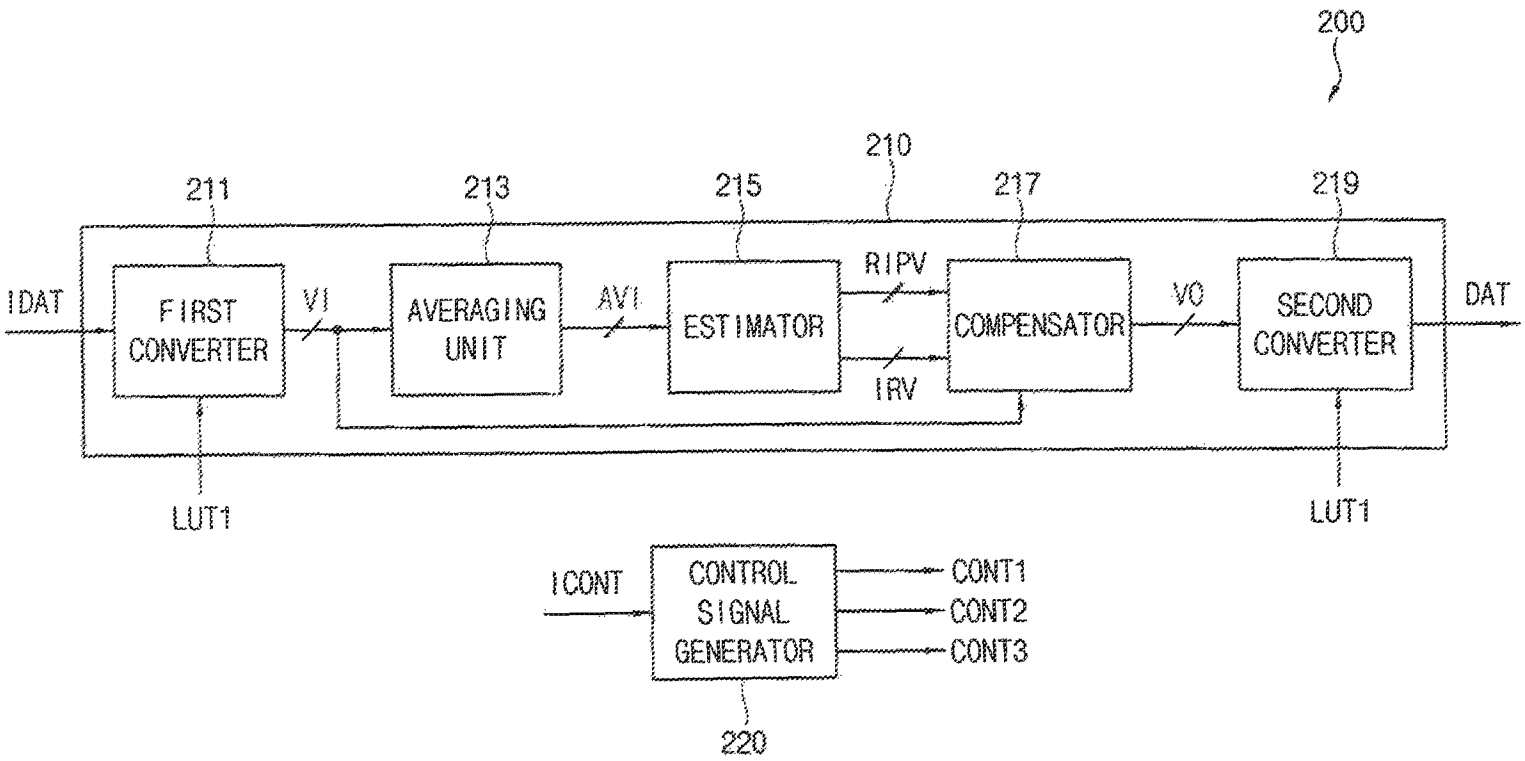
FIG. 5 is a block diagram illustrating a timing controller included in the display apparatus according to an exemplary embodiment of the inventive concept.

FIG. 5 is a block diagram illustrating a timing controller included in the display apparatus according to an exemplary embodiment of the inventive concept.

Referring to FIGS. 1 and 5, a timing controller 200 includes an image processor 210 and a control signal generator 220. Although the timing controller 200 of FIG. 5 is divided into two or six elements for convenience of explanation, embodiments of the timing controller is not limited thereto. For example, alternate embodiments of the timing controller 200 may be implemented as a single device, and the image processor 210 may be formed of less than six elements or more than six elements.

The image processor 210 may generate the plurality of output grayscales included in the output image data DAT by compensating the plurality of input grayscales included in the input image data IDAT. The image processor 210 may perform an adaptive color correction (ACC) for the grayscale compensation.

The image processor 210 includes a first converter 211 (e.g., a first circuit), an averaging unit 213 (e.g., a second circuit), an estimator 215 (e.g., a third circuit), a compensator 217 (e.g., a fourth circuit) and a second converter 219 (e.g., a fifth circuit).

The first converter 211 converts the plurality of input grayscales into a plurality of input voltages VI based on a lookup table LUT1. For example, the display panel 100 may include m horizontal lines and n vertical lines, where each of m and n is a natural number equal to or greater than two. The plurality of input grayscales may include first input grayscales (e.g., GI11~GI1*n*), second input grayscales (e.g., GI21~GI2*n*), . . . , and m-th input grayscales (e.g., GIm1~GImn). The first input grayscales may correspond to a first horizontal line, which is a beginning horizontal line. The second input grayscales may correspond to a second horizontal line that is subsequent to and adjacent to the first horizontal line. The m-th input grayscales may correspond to an m-th horizontal line, which is a last horizontal line. Similarly, the plurality of input voltages VI may include first input voltages (e.g., VI11~VI1*n*) corresponding to the first horizontal line, second input voltages (e.g., VI21~VI2*n*) corresponding to the second horizontal line, . . . , and m-th input voltages (e.g., VIm1~VImn) corresponding to the m-th horizontal line.

In an embodiment, the averaging unit 213 generates a plurality of average voltages AVI by averaging the plurality of input voltages VI by a unit of a single horizontal line. For example, the averaging unit 213 may generate a first average voltage (e.g., AVI1) by averaging the first input voltages (e.g., VI11~VI1*n*), may generate a second average voltage (e.g., AVI2) by averaging the second input voltages (e.g., VI21~VI2*n*), and may generate an m-th average voltage (e.g., AVIm) by averaging the m-th input voltages (e.g., VIm1~VImn).

In an embodiment, the estimator 215 generates an estimation value RIPV (e.g., an estimated variation on the level of the storage voltage VCST' due to a ripple) for a voltage variation associated with a current horizontal line (e.g., (x+1)-th horizontal line, where x is a natural number) based on an average voltage of a previous horizontal line (e.g., x-th horizontal line), an estimation value for a voltage variation associated with the previous horizontal line, and an average voltage of the current horizontal line. For example, a second estimation value (e.g., RIPV2) for a voltage variation associated with the second horizontal line may be obtained by Equation 1.

$$RIPV2=RIPV1*D*(AVI2-AVI1) \quad \text{[Equation 1]}$$

In Equation 1, RIPV1 represents a first estimation value for a voltage variation associated with the first horizontal line, D represents a constant based on an RC characteristic of the display panel 100, AVI1 represents the first average voltage of the first input voltages, and AVI2 represents the second average voltage of the second input voltages. For example, the first estimation value may be a predetermined constant because the first horizontal line is the beginning horizontal line. When an estimation value (e.g., RIPV3) for a voltage variation associated with a third horizontal line is calculated, the second estimation value may be used as the estimation value for the voltage variation associated with the previous horizontal line (e.g., RIPV3=RIPV2*D*(AVI3−AVI2)). For example, D may be "exp(−1/τ)".

In an embodiment, the compensator 217 generates a plurality of output voltages VO by compensating input voltages corresponding to the current horizontal line based on the estimation value RIPV for the voltage variation associated with the current horizontal line. For example, second output voltages (e.g., VO21~VO2*n*) may be generated by compensating the second input voltages (e.g., VI21~VI2*n*) corresponding to the second horizontal line by Equation 2 and Equation 3.

$$VO2k=VI2k-AA*RIPV2 \quad \text{[Equation 2]}$$

$$VO2k=VI2k+BB*RIPV2 \quad \text{[Equation 3]}$$

In Equation 2 and Equation 3, k is a natural number equal to or greater than one and equal to or smaller than n. Each of AA and BB is a constant, and may be changed depending on a location at the display panel 100. When VI2*k* corresponds to a positive polarity voltage, Equation 2 may be used for such compensation. When VI2*k* corresponds to a negative polarity voltage, Equation 3 may be used for such compensation.

The second converter 219 converts the plurality of output voltages VO into a plurality of output grayscales based on the lookup table LUT1. For example, the plurality of output voltages VO may include first output voltages (e.g., VO11~VO1*n*) corresponding to the first horizontal line, the second output voltages (e.g., VO21~VO2*n*) corresponding to the second horizontal line, . . . , and m-th output voltages (e.g., VOm1~VOmn) corresponding to the m-th horizontal line. Similarly, the plurality of output grayscales may include first output grayscales (e.g., GO11~GO1*n*) corresponding to the first horizontal line, second output grayscales (e.g., GO21~GO2*n*) corresponding to the second horizontal line, . . . , and m-th output grayscales (e.g., GOm1~GOmn) corresponding to the m-th horizontal line.

In an exemplary embodiment, the estimator 215 further generates an estimation value IRV (e.g., an estimated variation on the level of the storage voltage VCST' due to an IR drop) for the voltage variation associated with the current horizontal line based on the estimation value for the voltage variation associated with the previous horizontal line, and the average voltage of the current horizontal line. For example, a fourth estimation value (e.g., IRV2) for the voltage variation associated with the second horizontal line may be obtained by Equation 4.

$$IRV2=IRV1*(1-R)+AVI2*R \quad \text{[Equation 4]}$$

In Equation 4, IRV1 represents a third estimation value for the voltage variation associated with the first horizontal line, and R represents a constant based on the RC characteristic of the display panel 100. For example, the third estimation value may be a predetermined constant because the first horizontal line is the beginning horizontal line. When an estimation value (e.g., IRV3) for the voltage variation associated with the third horizontal line is calculated, the fourth estimation value may be used as the estimation value for the voltage variation associated with the previous horizontal line (e.g., IRV3=IRV2*(1−R)+AVI3*R). For example, R may be "1-exp(−1/τ)".

In an exemplary embodiment, the compensator 217 generates the plurality of output voltages VO by compensating the input voltages corresponding to the current horizontal line based on the estimation value RIPV for the voltage variation associated with the current horizontal line, and by additionally compensating the input voltages corresponding to the current horizontal line based on the estimation value IRV for the voltage variation associated with the current horizontal line. For example, the second output voltages (e.g., VO21~VO2*n*) may be generated by compensating the second input voltages (e.g., VI21~VI2*n*) corresponding to the second horizontal line by Equation 5 and Equation 6.

$$VO2k=VI2k-AA*RIPV2-CC*IRV2 \quad \text{[Equation 5]}$$

$$VO2k=VI2k+BB*RIPV2+DD*IRV2 \quad \text{[Equation 6]}$$

In Equation 5 and Equation 6, k is a natural number equal to or greater than one and equal to or smaller than n. Each of AA, BB, CC and DD is a constant, and may be changed depending on a location at the display panel 100. When VI2*k* corresponds to a positive polarity voltage, Equation 5 may be used for such compensation. When VI2*k* corresponds to a negative polarity voltage, Equation 6 may be used for such compensation.

In an exemplary embodiment, the timing controller 200 further includes a storage device that stores the lookup table LUT1. For example, the storage device may include, for example, at least one nonvolatile memory such as an erasable programmable read-only memory (EPROM), an electrically erasable programmable read-only memory (EEPROM), a flash memory, a phase-change random access memory (PRAM), a resistance random access memory (RRAM), a magnetic random access memory (MRAM), a ferroelectric random access memory (FRAM), a nano floating gate memory (NFGM), a polymer random access memory (PoRAM), etc. In an embodiment, the storage device is disposed outside the timing controller 200.

In an exemplary embodiment, the grayscale compensation is performed without converting grayscales into voltages, and then the first converter 211 and the second converter 219 may be omitted. In an exemplary embodiment, the grayscale compensation is performed for a desired region (e.g., the first region A1 in FIG. 2) on the display panel 100, and then the timing controller 200 may further include an image analyzer (e.g., an image analyzing circuit) for detecting the desired region. For example, the image analyzer may be used to determine whether a region is present having the first grayscale is present, whether a region having the first grayscale surrounded by a region having the second grayscale is present, or whether a region having the first grayscale adjacent a region having the second grayscale is present.

The control signal generator 220 may generate the first control signal CONT1 for the gate driver 300, the second control signal CONT2 for the data driver 400 and the third control signal CONT3 for the voltage generator 500 based on the input control signal ICONT.

Although not illustrated in FIG. 5, the timing controller 200 may further include an element (e.g., a circuit) or a block that performs an image quality compensation, a spot compensation, a dynamic capacitance compensation (DCC) and/or a dithering on the input image data IDAT.

Figure 6:
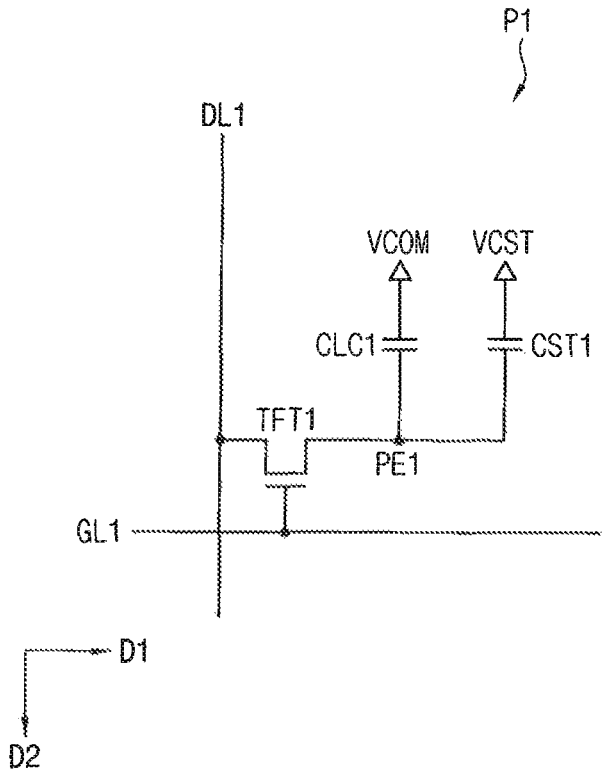
FIGS. 6 and 7 are circuit diagrams illustrating examples of a pixel included in the display apparatus according to an exemplary embodiment of the inventive concept.
Figure 7:
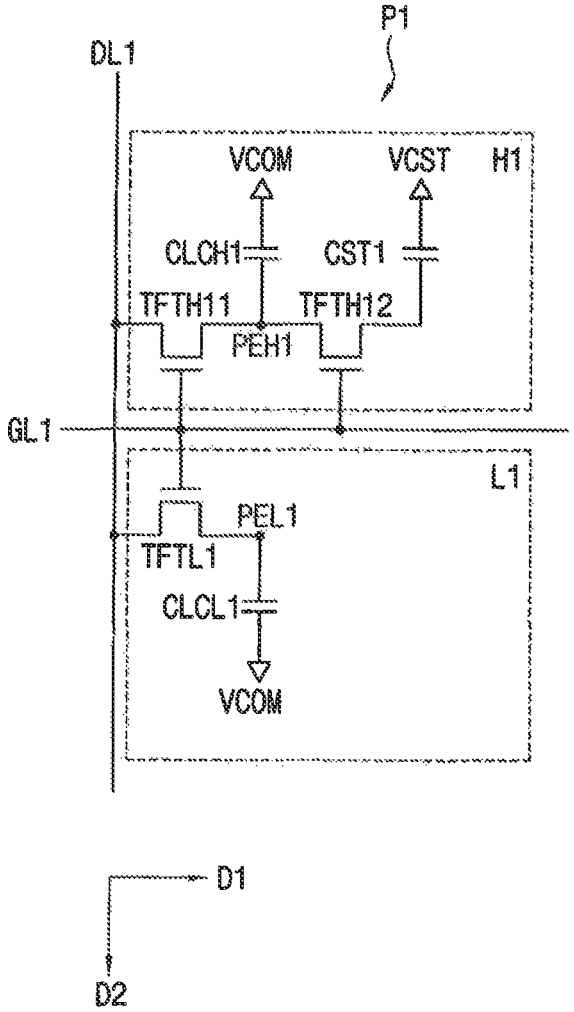

FIGS. 6 and 7 are circuit diagrams illustrating examples of a pixel included in the display apparatus according to exemplary embodiments of the inventive concept.

Referring to FIG. 6, a first pixel P1 includes a first pixel electrode PE1 and a first switching element TFT1. For example, the first switching element TFT1 may be a thin film transistor (TFT).

The first switching element TFT1 may apply a first data voltage (e.g., VD1 in FIG. 3) to the first pixel electrode PE1. A first liquid crystal capacitor CLC1 is located between the first pixel electrode PE1 and a common electrode to which the common voltage VCOM is applied. A first storage capacitor CST1 is located between the first pixel electrode PE1 and a storage electrode to which the storage voltage VCST is applied.

The first switching element TFT1 includes a first electrode connected to a first data line DL1 receiving the first data voltage, a control electrode (e.g., a gate electrode) connected to a first gate line GL1, and a second electrode connected to the first pixel electrode PE1.

Referring to FIG. 7, a first pixel P1 includes a first high pixel H1 (e.g., a first sub-pixel) and a first low pixel L1 (e.g., a second sub-pixel).

The first high pixel H1 includes a first pixel electrode PEH1, a first switching element TFTH11 (e.g., a first TFT) and a second switching element TFTH12 (e.g., a second TFT). The first switching element TFTH11 may apply a first data voltage (e.g., VD1 in FIG. 3) to the first pixel electrode PEH1. The second switching element TFTH12 may apply the storage voltage VCST to the first pixel electrode PEH1. A first liquid crystal capacitor CLCH1 is located between the first pixel electrode PEH1 and a common electrode to which the common voltage VCOM is applied. A first storage capacitor CST1 is located between a first electrode of the second switching element TFTH12 and a storage electrode to which the storage voltage VCST is applied.

The first low pixel L1 includes a second pixel electrode PEL1 and a third switching element TFTL1. The third switching element TFTL1 may apply the first data voltage to the second pixel electrode PELT. A second liquid crystal capacitor CLCL1 is formed between the second pixel electrode PEL1 and the common electrode.

The first switching element TFTH11 includes a first electrode connected to a first data line DL1 receiving the first data voltage, a control electrode connected to a first gate line GL1, and a second electrode connected to the first pixel electrode PEH1. The second switching element TFTH12 includes a first electrode connected to the first storage capacitor CST1, a control electrode connected to the first gate line GL1, and a second electrode connected to the first pixel electrode PEH1. The third switching element TFTL1 includes a first electrode connected to the first data line DL1, a control electrode connected to the first gate line GL1, and a second electrode connected to the second pixel electrode PEL1.

In an exemplary embodiment, a size of the high pixel H1 is equal to or smaller than a size of the low pixel L1. In an embodiment, a size of the first pixel electrode PEH1 is equal to or smaller than a size of the second pixel electrode PEL1. In an embodiment, a ratio between the size of the high pixel H1 and the size of the low pixel L1 is about 1:2.

In an exemplary embodiment, a resistance of the first switching element TFTH11 is smaller than a resistance of the second switching element TFTH12. In an embodiment, a width to length (W/L) ratio of a channel of the first switching element TFTH11 is greater than a width to length (W/L) ratio of a channel of the second switching element TFTH12.

Although not illustrated in FIGS. 6 and 7, the first pixel P1 may further include an additional component for receiving the storage voltage VCST.

Although a single pixel P1 is illustrated in FIGS. 6 and 7, FIGS. 6 and 7 may be applied other pixels of the display panel 100 in FIG. 1. For example, the pixel structures in FIGS. 6 and 7 may be repeated throughout a display area of the display panel 100.

Figure 8:
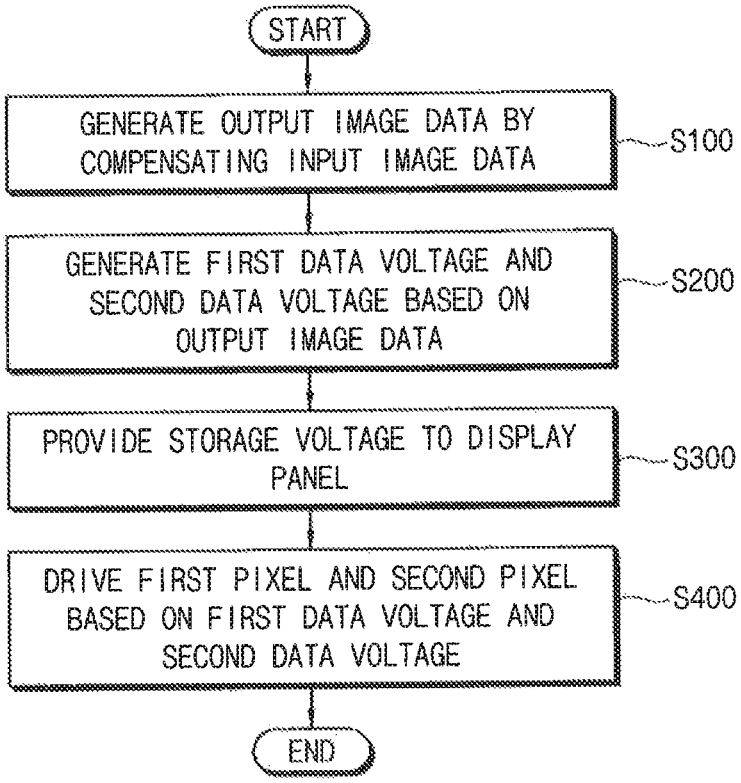
FIG. 8 is a flow chart illustrating a method of operating a display apparatus according to an exemplary embodiment of the inventive concept.

FIG. 8 is a flow chart illustrating a method of operating a display apparatus according to an exemplary embodiment of the inventive concept.

Referring to FIGS. 1, 2, 3 and 8, in the method of operating the display apparatus 10 according to an exemplary embodiment of the inventive concept, the output image data DAT is generated by compensating the input image data IDAT (step S100). It is assumed that the compensating is being performed based on a variation on the level of the storage voltage VCST'. The first data voltage VD1 and the second data voltage VD2 are generated based on the output image data DAT (step S200). The first data voltage VD1 has a positive polarity with respect to the common voltage VCOM, and the second data voltage VD2 has a negative polarity with respect to the common voltage VCOM. The storage voltage VCST is provided to the display panel 100 (step S300). The first pixel P1 and the second pixel P2 included in the display panel 100 are driven based on the first data voltage VD1 and the second data voltage VD2, respectively (step S400).

As discussed above, it is assumed that the variation on the level of the storage VCST has occurred. For example, as illustrated in FIGS. 2 and 3, when the display panel 100 displays the first frame image FIMG1 based on the output image data DAT, when the first frame image FIMG1 is divided into the first region A1 having the first grayscale and the second region A2 having the second grayscale lower than the first grayscale, and when the first pixel P1 and the second pixel P2 are located in the first region A1, the variation on the level of the storage voltage VCST' applied to the pixels P1 and P2 may occur.

The data voltages applied to the pixels may be compensated (e.g., shifted) based on the grayscale compensation performed by step S100. For example, as illustrated in FIG. 3, the level of the first data voltage VD1 is shifted from the first normal level PH to the first compensation level PC in the first direction, and the level of the second data voltage VD2 is shifted from the second normal level NH to the second compensation level NC in the first direction.

In an exemplary embodiment, as the variation amount of the level of the storage voltage VCST' increases, both the shift amount of the level of the first data voltage VD1 and the shift amount of the level of the second data voltage VD2 increases. For example, as the size of the first region A1 increases, as the difference between the first grayscale and the second grayscale increases, or as the distance between the first region A1 and the data driver 400 increases, the variation amount of the level of the storage voltage VCST' increases, and thus both the shift amount of the level of the first data voltage VD1 and the shift amount of the level of the second data voltage VD2 increases.

In an exemplary embodiment, the difference between the first normal level PH and the level of the common voltage VCOM is greater than the difference between the first compensation level PC and the level of the common voltage VCOM. In an exemplary embodiment, the difference between the second normal level NH and the level of the common voltage VCOM is less than the difference between the second compensation level NC and the level of the common voltage VCOM.

In an exemplary embodiment, the shift amount of the level of the first data voltage VD1 may be substantially the same as or different from the shift amount of the level of the second data voltage VD2.

Figure 9:
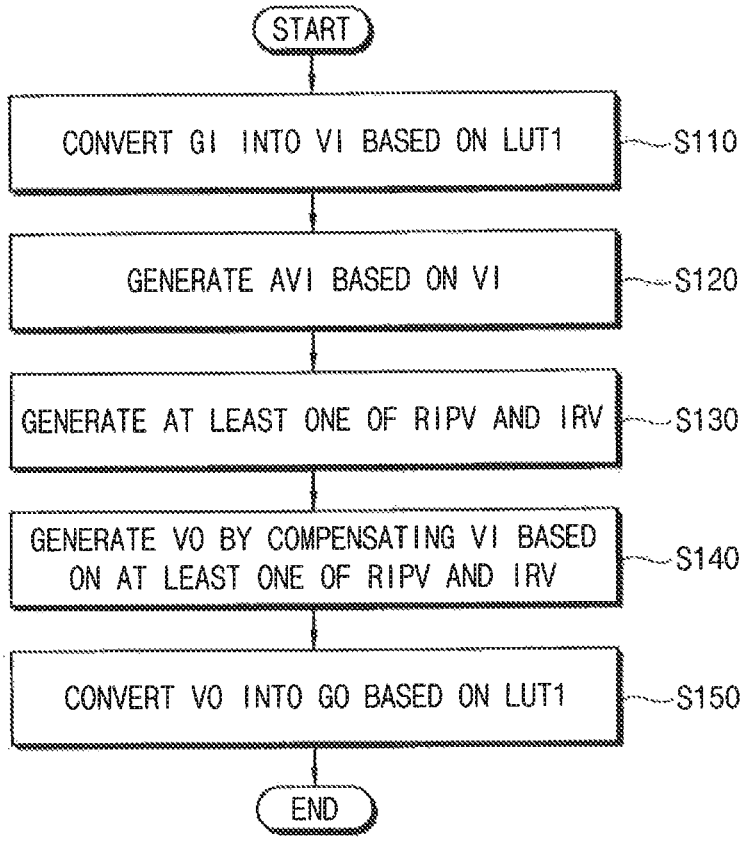
FIG. 9 is a flow chart illustrating a method of generating output image data in FIG. 8 according to an exemplary embodiment of the inventive concept.

FIG. 9 is a flow chart illustrating a method of generating output image data in FIG. 8 according to an exemplary embodiment of the inventive concept. The method of FIG. 9 may be used to implement the step S100 of FIG. 8, which generates the output image data by compensating the input data.

Referring to FIGS. 1, 5, 8 and 9, the plurality of input grayscales (e.g., GI) included in the input image data IDAT are converted into the plurality of input voltages VI based on the lookup table LUT1 (step S110). The plurality of average voltages AVI are generated by averaging the plurality of input voltages VI by a unit of a single horizontal line (step S120). At least one of the estimation values RIPV and IRV for the voltage variation associated with the current horizontal line is generated (step S130). The generation of the estimation values RIPV and IRV may be performed based on the average voltage of the previous horizontal line, the estimation value for the voltage variation associated with the previous horizontal line, and the average voltage of the current horizontal line. The plurality of output voltages VO are generated by compensating the input voltages corresponding to the current horizontal line based on at least one of the estimation values RIPV and IRV for the voltage variation associated with the current horizontal line (step S140). The plurality of output voltages VO are converted into the plurality of output grayscales (e.g., GO) based on the lookup table LUT1 (step S150).

Each of steps S110, S120, S130, S140 and S150 may be substantially the same as the operations of the first converter 211, the averaging unit 213, the estimator 215, the compensator 217 and the second converter 219, respectively.

Figure 10:
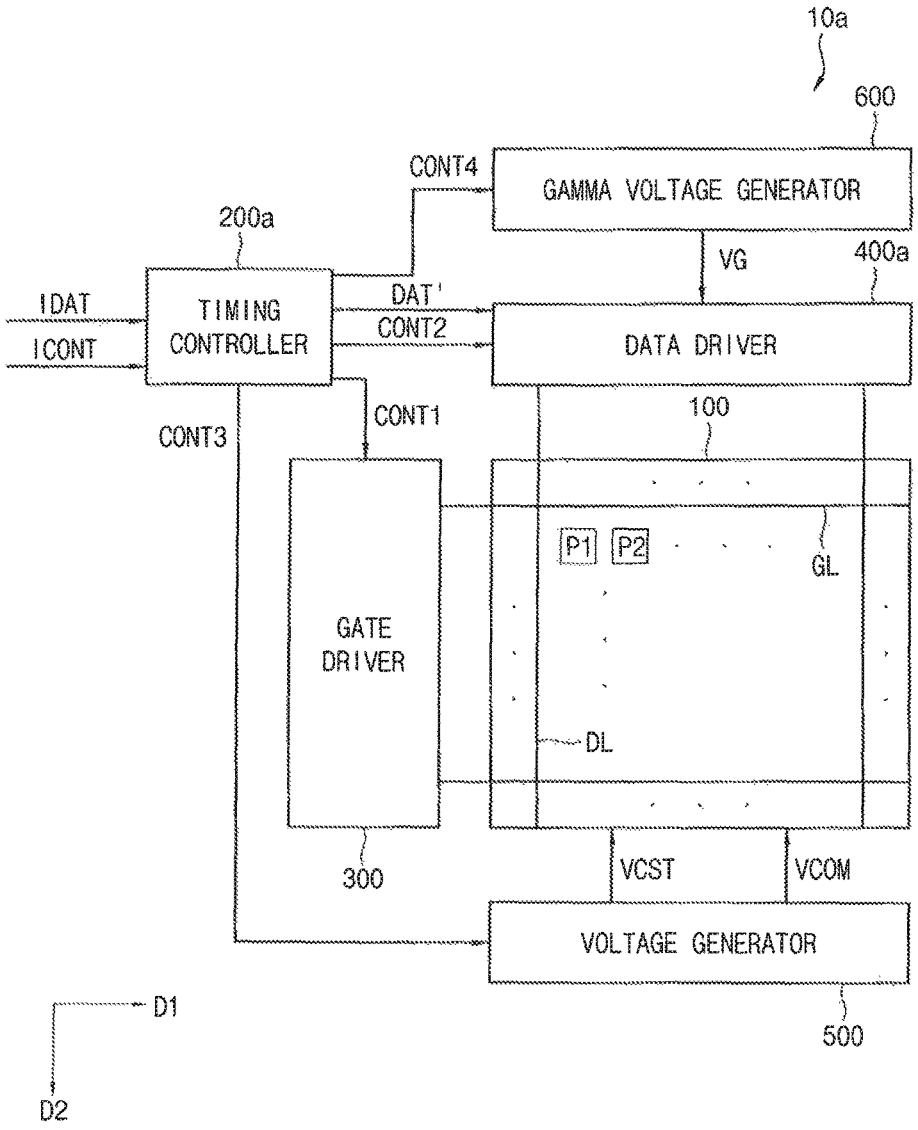
FIG. 10 is a block diagram illustrating a display apparatus according to an exemplary embodiment of the inventive concept.

FIG. 10 is a block diagram illustrating a display apparatus according to an exemplary embodiment of the inventive concept.

Referring to FIG. 10, a display apparatus 10*a* includes a display panel 100, a timing controller 200*a*, a gate driver 300, a data driver 400*a*, a voltage generator 500 and a gamma voltage generator 600.

The display apparatus 10*a* of FIG. 10 may be substantially the same as the display apparatus 10 of FIG. 1, except that the display apparatus 10*a* further includes the gamma voltage generator 600, and signals generated by the timing controller 200*a* and the data driver 400*a* are changed or added.

The timing controller 200*a* generates output image data DAT' based on the input image data IDAT. The timing controller 200*a* generates the first control signal CONT1, the second control signal CONT2, the third control signal CONT3 and a fourth control signal CONT4 based on the input control signal ICONT. The gamma voltage generator 600 generates a gamma reference voltage VG based on the fourth control signal CONT4. The data driver 400*a* generates the plurality of data voltages for driving the data lines DL based on the output image data DAT', the second control signal CONT2 and the gamma reference voltage VG.

Similar to the examples described with reference to FIGS. 2 and 3, the first pixel P1 and the second pixel P2 may operate or may be driven based on data voltages having different polarities, and the variation on the level of the storage voltage VCST' applied to the pixels P1 and P2 may occur. In the embodiment of FIG. 10, the timing controller 200*a* does not compensate the input grayscales in the input image data IDAT. Instead, the timing controller 200*a* generates the fourth control signal CONT4 for controlling the gamma voltage generator 600. The gamma voltage generator 600 adjusts the gamma reference voltage VG based on the fourth control signal CONT4, and then the grayscale compensation is performed based on the adjusted gamma reference voltage VG. Thus, the gamma voltage generator 600 may compensate the first data voltage VD1 and the second data voltage VD2 as illustrated in FIG. 3 in response to the fourth control signal CONT4, such that the level of the first data voltage VD1 is shifted from the first normal level PH to the first compensation level PC in the first direction, and the level of the second data voltage VD2 is shifted from the second normal level NH to the second compensation level NC in the first direction.

Although exemplary embodiments are described based on examples of specific pixels (e.g., FIGS. 6 and 7) and examples of a specific frame image (e.g., FIG. 2), the inventive concept is not limited thereto. For example, embodiments of the inventive concept may be applied to a display apparatus including various different types of pixels and a display apparatus presenting various different frame images, where a variation on the level of the storage voltage has occurred.

At least one embodiment of the inventive concept may be used in a display apparatus and/or a system including the display apparatus, such as a mobile phone, a smart phone, a personal digital assistant (PDA), a portable multimedia player (PMP), a digital camera, a digital television, a set-top box, a music player, a portable game console, a navigation device, a personal computer (PC), a server computer, a workstation, a tablet computer, a laptop computer, etc.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the present inventive concept. Accordingly, all such modifications are intended to be included within the scope of the present inventive concept.

What is claimed is:

1. A display apparatus comprising:

a timing controller for determining a variation on a level of a storage voltage using input image data and compensating the input image data to generate output image data using the variation;

a data driver configured to generate a first data voltage and a second data voltage based on the output image data, the first data voltage having a positive polarity with respect to a common voltage, the second data voltage having a negative polarity with respect to the common voltage; and a display panel including a first pixel driven based on the first data voltage and a second pixel driven based on the second data voltage, the display panel configured to receive the storage voltage applied to the first pixel and the second pixel, wherein the timing controller performs the compensating by shifting a level of the first data voltage from a first normal level to a first compensation level in a direction using the variation, and shifting a level of the second data voltage from a second normal level to a second compensation level in the same direction using the variation.

2. The display apparatus of claim 1, wherein, as a variation amount of the variation of the level of the storage voltage increases, both a shift amount the level of the first data voltage is shifted and a shift amount the level of the second data voltage is shifted increase.

3. The display apparatus of claim 1, wherein a shift amount the level of the first data voltage is shifted is different from a shift amount the level of the second data voltage is shifted.

4. The display apparatus of claim 1, wherein the first pixel comprises:

a first pixel electrode;

a first storage capacitor; and a first switching element connected between the first pixel electrode and a first data line to which the first data voltage is applied, the first switching element including a control electrode connected to a first gate line, wherein the first storage capacitor is located between the first pixel electrode and a storage electrode to which the storage voltage is applied.

5. The display apparatus of claim 1, wherein the first pixel comprises: a first sub-pixel comprising:

a first pixel electrode;

a first switching element connected between the first pixel electrode and a first data line to which the first data voltage is applied, the first switching element including a control electrode connected to a first gate line;

a second switching element connected between the first pixel electrode and the storage voltage, the second switching element including a control electrode connected to the first gate line; and a first storage capacitor located between the second switching element and a storage electrode to which the storage voltage is applied, a second sub-pixel comprising: a second pixel electrode; and a third switching element connected between the second pixel electrode and the first data line, the third switching element including a control electrode connected to the first gate line.

6. The display apparatus of claim 1, wherein a difference between the first normal level and a level of the common voltage is greater than a difference between the first compensation level and the level of the common voltage, wherein a difference between the second normal level and the level of the common voltage is less than a difference between the second compensation level and the level of the common voltage.

7. The display apparatus of claim 6, wherein the timing controller is configured to decrease a first grayscale among a plurality of input grayscales included in the input image data and configured to increase a second grayscale among the plurality of input grayscales, wherein the first grayscale corresponds to the first pixel and the first data voltage having the positive polarity, and the second grayscale corresponds to the second pixel and the second data voltage having the negative polarity.

8. The display apparatus of claim 1, wherein a frame image is displayed on the display panel based on the output image data, wherein the frame image is divided into a first region having a first grayscale and a second region having a second grayscale lower than the first grayscale, wherein the first pixel and the second pixel are located in the first region.

9. The display apparatus of claim 8, wherein, as a size of the first region increases, a variation amount of the variation of the level of the storage voltage increases, and both a shift amount the level of the first data voltage is shifted and a shift amount the level of the second data voltage is shifted increase.

10. The display apparatus of claim 8, wherein, as a difference between the first grayscale and the second grayscale increases, a variation amount of variation of the level of the storage voltage increases, and both a shift amount the level of the first data voltage is shifted and a shift amount the level of the second data voltage is shifted increase.

11. The display apparatus of claim 1, wherein the timing controller comprises:

an image processor configured to generate a plurality of output grayscales included in the output image data by compensating a plurality of input grayscales included in the input image data.

12. The display apparatus of claim 11, wherein the image processor includes:

a first circuit configured to convert the plurality of input grayscales into a plurality of input voltages based on a lookup table;

a second circuit configured to generate a first average voltage of first input voltages among the plurality of input voltages and a second average voltage of second input voltages among the plurality of input voltages, the first input voltages corresponding to a first horizontal line of the display panel, the second input voltages corresponding to a second horizontal line of the display panel adjacent to the first horizontal line;

a third circuit configured to generate a second estimation value for a voltage variation associated with the second horizontal line based on the first average voltage, the second average voltage and a first estimation value for a voltage variation associated with the first horizontal line;

a fourth circuit configured to compensate the second input voltages based on the second estimation value; and a fifth circuit configured to convert the compensated second input voltages into some grayscales among the plurality of output grayscales based on the lookup table.

13. The display apparatus of claim 12, wherein the third circuit is configured to further generate a fourth estimation value for the voltage variation associated with the second horizontal line based on the second average voltage and a third estimation value for the voltage variation associated with the first horizontal line, wherein the fourth circuit is configured to additionally compensate the second input voltages based on the fourth estimation value.

14. The display apparatus of claim 1, wherein the compensating generates a value from the variation, subtracts the value from the first data voltage and adds the value to the second data voltage.

15. The display apparatus of claim 14, wherein the value is calculated based a previous estimation value for a current horizontal line of the first and second pixels, an average data voltage of the current horizontal line, and an average data of a horizontal line that is previous to the current horizontal line.

16. The display apparatus of claim 15, wherein the value is a multiple of the previous estimation value, and a difference between the average data voltages.

17. A method of operating a display apparatus, the method comprising:

determining a variation on a level of a storage voltage using input image data;

compensating the input image data to generate output image data using the the variation;

generating a first data voltage and a second data voltage based on the output image data, the first data voltage having a positive polarity with respect to a common voltage, the second data voltage having a negative polarity with respect to the common voltage;

providing the storage voltage to a display panel included in the display apparatus; and driving a first pixel and a second pixel included in the display panel based on the first data voltage and the second data voltage, respectively, wherein the compensating comprises shifting a level of the first data voltage from a first normal level to a first compensation level in a direction using the variation, and shifting a level of the second data voltage from a second normal level to a second compensation level in the same direction using the variation.

18. The method of claim 17, wherein, as a variation amount of the variation of the level of the storage voltage increases, both a shift amount the level of the first data voltage is shifted and a shift amount the level of the second data voltage is shifted increase.

19. The method of claim 17, wherein a difference between the first normal level and a level of the common voltage is greater than a difference between the first compensation level and the level of the common voltage, wherein a difference between the second normal level and the level of the common voltage is less than a difference between the second compensation level and the level of the common voltage.

20. The method of claim 17, wherein a frame image is displayed on the display panel based on the output image data, wherein the frame image is divided into a first region having a first grayscale and a second region having a second grayscale lower than the first grayscale, wherein the first pixel and the second pixel are located in the first region.

21. The method of claim 20, wherein, as a size of the first region increases or as a difference between the first grayscale and the second grayscale increases, a variation amount of the variation of the level of the storage voltage increases, and both a shift amount the level of the first data voltage is shifted and a shift amount the level of the second data voltage is shifted increase.

22. The method of claim 17, wherein the compensating comprises:

converting a plurality of input grayscales included in the input image data into a plurality of input voltages based on a lookup table;

generating a first average voltage of first input voltages among the plurality of input voltages and a second average voltage of second input voltages among the plurality of input voltages, the first input voltages corresponding to a first horizontal line of the display panel, the second input voltages corresponding to a second horizontal line of the display panel adjacent to the first horizontal line;

generating a second estimation value for a voltage variation associated with the second horizontal line based on the first average voltage, the second average voltage and a first estimation value for a voltage variation associated with the first horizontal line;

compensating the second input voltages based on the second estimation value; and converting the compensated second input voltages into some grayscales among a plurality of output grayscales included in the output image data based on the lookup table.

23. The method of claim 22, wherein the compensating further comprises:

generating a fourth estimation value for the voltage variation associated with the second horizontal line based on the second average voltage and a third estimation value for the voltage variation associated with the first horizontal line; and compensating the second input voltages based on the fourth estimation value.

24. A display apparatus comprising:

a timing controller for compensating input image data for first and second pixels within a first region having a first grayscale to generate output image data when the first and second pixels are adjacent a second region having a second grayscale lower than the first grayscale;

a data driver configured to generate a first data voltage and a second data voltage based on the output image data, the first data voltage having a positive polarity with respect to a common voltage, the second data voltage having a negative polarity with respect to the common voltage; and a display panel including a first pixel driven based on the first data voltage and a second pixel driven based on the second data voltage, the display panel configured to receive the storage voltage applied to the first pixel and the second pixel, wherein the timing controller performs the compensating by shifting a level of the first data voltage from a first normal level to a first compensation level in a direction, and shifting a level of the second data voltage from a second normal level to a second compensation level in the same direction, wherein the first region causes a variation on a level of the storage voltage.

* * * * *